United States Patent [19]

Tanasawa et al.

[11] 4,280,661

[45] Jul. 28, 1981

[54] INTERMITTENT INJECTION TYPE FUEL INJECTION VALVE

[75] Inventors: Yasusi Tanasawa; Akinori Saito; Kiyomi Kawamura, all of Nagoya, Japan

[73] Assignee: Kabushiki Kaisha Toyoto Chuo Kenkyusho, Aichi, Japan

[21] Appl. No.: 75,163

[22] Filed: Sep. 12, 1979

[30] Foreign Application Priority Data

Sep. 22, 1978 [JP] Japan ..... 53/116931

[51] Int. Cl.[3] ..... F02M 51/06

[52] U.S. Cl. ..... 239/409; 239/431; 239/585

[58] Field of Search ..... 239/95, 408, 409–411, 239/426, 431, 434, 456, 459, 533.2, 533.12, 585

[56] References Cited

U.S. PATENT DOCUMENTS

| | | | |
|---|---|---|---|
| 1,285,907 | 11/1918 | Blakely | 239/408 X |
| 1,393,090 | 10/1921 | Cowardin | 239/408 X |
| 1,793,154 | 2/1931 | Bellem et al. | 239/410 |

*Primary Examiner*—Andres Kashnikow
*Attorney, Agent, or Firm*—Oblon, Fisher, Spivak, McClelland & Maier

[57] ABSTRACT

An intermittent injection type fuel injection valve including a nozzle body comprising a hollow cylindrical member and having a valve seat and an injection port, valve comprising a movable member having a valve seat interposed into the nozzle body and intermittently reciprocated therein; a compressed air supply passage communicating with a compressed air supply source and having an air opening provided on or near at least one of the valve seats of the nozzle body and movable member; and a compressed fuel supply passage communicating with a compressed fuel supply source and having at least one fuel opening provided on the valve seat of the nozzle body and movable member, the valve intermittently controlling the on-off communication of the air and fuel openings of the compressed air and fuel supply passages, and the fuel opening of the compressed fuel supply passage being positioned closer to the injection port than the air opening of the compressed air supply passage. Thus, compressed fuel is supplied to the flow of the compressed air between the valve seats of the nozzle body and movable member, and the mixture of the compressed fuel and air in the form of extremely fine fuel droplets is injected from the injection port at a preset timing in a stable manner under any driving condition of an engine.

13 Claims, 16 Drawing Figures

INTERMITTENT INJECTION TYPE FUEL INJECTION VALVE

BACKGROUND OF THE INVENTION

1. Field of the Invention

The present invention relates to an intermittent injection type fuel injection valve for an internal combustion engine and particularly for a gasoline engine.

2. Description of the Prior Art

As the demand for the fuel economy and purification of exhaust gases of an internal combustion engine of an automobile is being increased more and more, carburetors are being replaced by an increasing number of electric type fuel injection devices (which will be shortly referred to as an EFI injection valve) which can delicately control the flow rate of fuel.

However, the atomizing characteristics of the EFI injection valve being used are not sufficient. In a manifold injection system, more specifically, the atomized fuel will wet the inner walls of a manifold and combustion chambers so that the fuel mixing operation cannot be accomplished satisfactorily. This results in an increase in the hydrocarbon contents which is detrimental to the exhaust gas emission control. Especially during the cold starting of the automobile, the fuel injected has a small evaporation rate so that the fuel consumption rate and the exhaust purification percentage at cold start are deteriorated in comparison with those of a carburetor.

SUMMARY OF THE INVENTION

The primary object of the present invention is to provide a novel intermittent injection type fuel injection valve suitable for an internal combustion engine and particularly for a gasoline engine.

Another object of the present invention is to provide an intermittent injection type fuel injection valve having excellent fuel atomizing characteristics under any driving condition of an engine.

A further object of the present invention is to provide a fuel injection valve in which fuel is injected at a position closer to the injection port and air is supplied at a position farther from the injection port in order to positively make compressed air streams collide with fuel and to mix the compressed air and fuel, thus obtaining remarkably fine fuel droplets which have thus far been unobtainable.

A still further object of the present invention is to provide a fuel injection valve which effects excellent fuel atomization even at the cold start of an engine, thus preventing emission of noxious gases due to the incomplete combustion, ensuring a stable and smooth operation of an engine and reducing the fuel cost.

An additional object of the present invention is to provide a fuel injection valve in which the compressed air is supplied from upstream of the fuel supply position so that the leakage of fuel through the clearance between the valve device and the nozzle body can be prevented by the action of the air pressure.

Yet another object of the present invention is to provide a fuel injection valve in which the air and fuel flow rates are easily and precisely controlled by controlling the valve opening time.

A still further object of the present invention is to provide a fuel injection valve having excellent durability and reliability, and having a simplified construction to allow facilitated manufacturing, machining and assembly at a low cost thus suited for mass production.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

FIGS. 1 to 3 show an EFI injection valve according to the prior art, wherein FIG. 1 is a longitudinal section showing the EFI injection valve;

FIG. 2 is a diagrammatical view showing the case, in which the EFI injection valve is applied to the intake system of an internal combustion engine; and FIG. 3 is a graphical presentation showing the relationship between the power supply time and the flow rate of the fuel injected by the EFI injection valve;

FIGS. 7 to 10 show one embodiment of the present invention, wherein: FIG. 7 is a longitudinal section showing the embodiment; FIG. 8 is an enlarged section showing the essential portion of the embodiment; FIG. 9 is a diagrammatical view showing the case, in which the embodiment is applied to the intake system of an internal combustion engine; and FIG. 10 is a graphical presentation comparing the influences of the mean diameter of the atomized fuel droplets upon the air pressure between the EFI injection valve according to the prior art and the injection valve according to the embodiment; and, FIGS. 11 through 16 are enlarged sections showing other embodiments of the present invention, respectively.

DETAILED DESCRIPTION OF THE PREFERRED EMBODIMENTS

Figure 1:
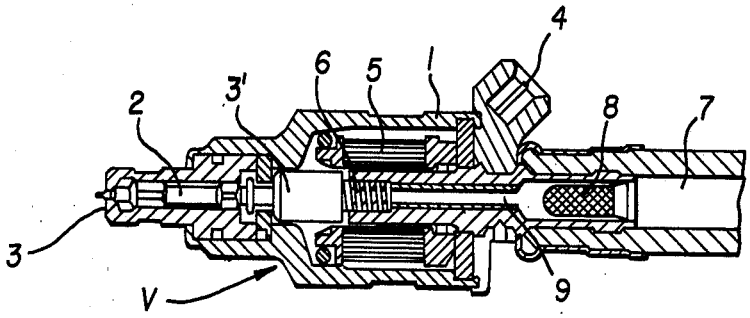
FIG. 1 PRIOR ART

Here, description will be made with respect to an EFI injection valve V being used at present. As shown in FIG. 1, the EFI injection valve V has such construction that a needle valve 2 is fitted smoothly and reciprocally in a nozzle body 1. This nozzle body 1 has its leading end formed with an injection port 3, which can be opened and closed by the leading end of the aforementioned needle valve 2 arranged to face in an abutting manner.

When a current is fed through an electric signal input terminal 4 to a solenoid coil 5, an electromagnetic force is generated to attract the plunger 3' which is located at the rear portion of the needle valve. For this purpose, the needle valve 2 is biased by a spring 6 to close the aforementioned injection port 3 and is moved together with the plunger 3', when electromagnetically attracted, to open the injection port 3. Since the fuel is pressurized by a pump (not shown) and guided through a pipe 7 and a filter 8 into a fuel supply passage 9 in the nozzle body 1, it is injected to the outside when the injection port 3 is opened. By changing the current supply time to the solenoid coil 5, the time (which will be shortly referred to as the valve opening time) during which the injection port 3 is opened is accordingly changed so that the fuel injecting time is also changed together with the fuel flow rate.

Figure 2:
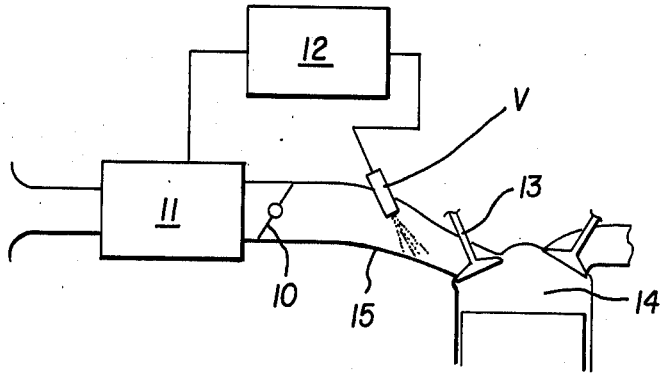
FIG. 2 PRIOR ART

Turning now to FIG. 2 showing the diagrammatical view of the control system in the case of application to an automotive engine, electric signals according to the air flow rate are generated by an air flow meter 11 arranged upstream of a throttle valve 10, and electric pulses according to the air flow rate are generated by a computer 12 so that the valve opening time of the EFI injection valve V is controlled to control the fuel flow rate. In order to prevent the fuel injected from wetting the wall surface of an intake manifold 15 as much as possible, generally speaking, the EFI injection valve is positioned as close to an intake valve 13 as possible. If the atomized condition of the fuel is not proper, therefore, the fuel is sucked, while being left insufficiently evaporated, into a combustion chamber 14 due to the closeness to the intake valve 13 to deteriorate the combustion condition and accordingly, the fuel economy and the exhaust purifying percentage.

Figure 3:
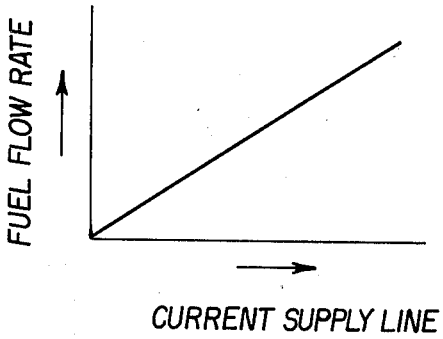
FIG. 3 PRIOR ART

FIG. 3 shows the relationship between the power supply time of the EFI injection valve and the flow rate of the fuel injected. In FIG. 2, the inputs of the computer 12 are simplified with the exception of the output from the air flow meter. In actual practice, however, the EFI injection valve is receptive with respect to the temperature of cooling water, the angular position of the throttle valve and the output of an air-fuel ratio sensor so that it can accomplish fine control of the fuel flow rate.

As has been understood from the above description, the conventional EFI injection valve can delicately control the fuel flow rate in accordance with the driving condition of the automobile by electrically controlling its valve opening time. Because of this particular advantage, the carburetor which has been widely used as a fuel feeder of an engine is being replaced by the EFI injection valve.

In view of the controllability of the fuel flow rate, the EFI injection valve can be concluded as being a remarkably excellent device. However, the EFI injection valve being used cannot always ensure sufficient atomization, as has been touched on before. In this respect, the mean diameter of the atomized fuel droplets measured is found to have a value of about 450 to 500 μm. On the other hand, the mean diameter of the atomized droplets obtainable for the carburetor is said to usually have a value of 50 to 150 μm. In view of this comparison, the atomization of the EFI injection valve at the present stage cannot be said to be at a satisfactory level.

Since, moreover, the EFI injection valve is positioned as close to the intake valve 13 as possible, as mentioned hereinabove, there is high possibility of the fuel being sucked into the combustion chamber 14, while being left under an insufficiently atomized condition so that the combustion condition is accordingly deteriorated. This deterioration is prominent before the engine is not sufficiently warmed up, thus inviting remarkable reduction in the fuel economy and the exhaust purifying percentage.

Figure 4:
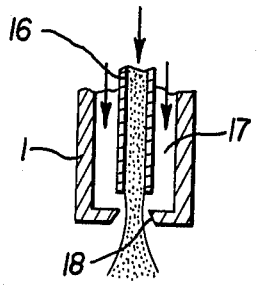
FIG. 4 PRIOR ART
FIG. 4 is a diagrammatical view showing a continuous injection type fuel injection valve according to the prior art.

On the other hand, a fuel injection valve has been used as an injection valve capable of enjoying an excellent atomized condition. As shown in FIG. 4, more specifically, the continuous injection type fuel injection valve has such construction that the fuel is supplied to a fuel supply pipe 16 which is provided at the center of the nozzle body 1 and that the air is made to flow through the clearance 17 around the fuel supply pipe 16. Thus, when the fuel passes through an injection port 18, it is sheared by the air flowing therearound at a high speed so that a remarkably excellent atomized condition (under which the mean diameter of the atomized droplets has a value of 20 to 100 μm) can be established.

Since, however, both the fuel and air flow continuously in the continuous injection type fuel injection valve, a throttle (not shown) has to be provided for controlling purposes if their flow rates and the flow paths of the atomized fuel are to be changed. The control of the throttle to be added is so complex that precision control cannot be satisfactorily obtained. In order to use the continuous injection type fuel injection valve as the fuel supply device for the automotive engine, on the other hand, both wide control range and the high responsiveness are required, but it is quite difficult to realize such throttle and its control device so as to satisfy those requirements.

Figure 5:
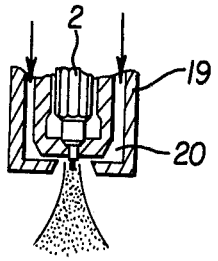
FIG. 5 PRIOR ART
FIG. 5 is a diagrammatical view showing a conventional intermittent type fuel injection valve.
Figure 6:
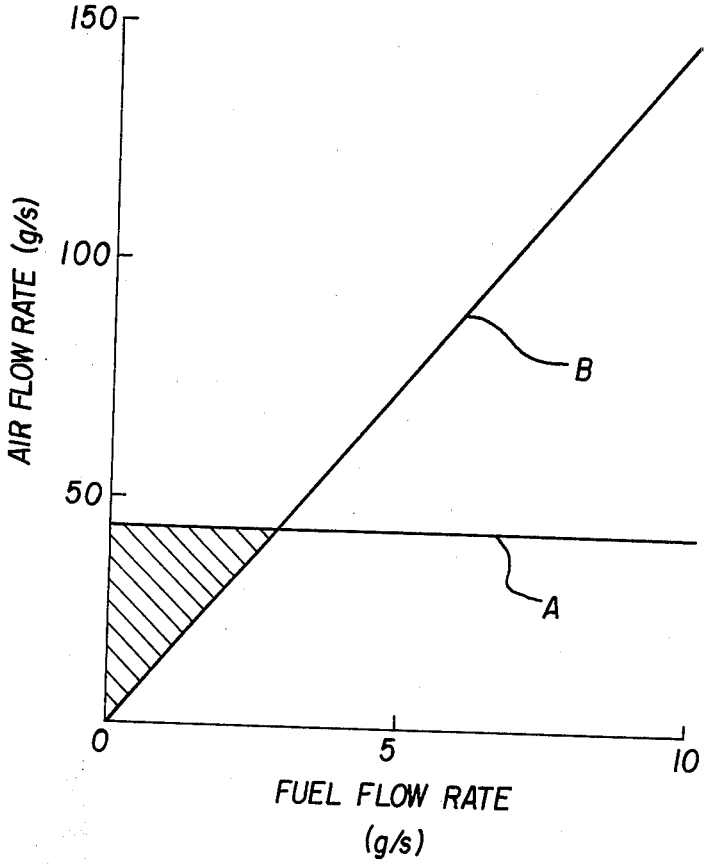
FIG. 6 PRIOR ART
FIG. 6 is a graphical presentation showing the relationship between the fuel flow rate and the air flow rate of the injection valve shown in FIG. 5.

As another means for the above purposes, there is also provided an intermittent injection type fuel injection valve, as shown in FIG. 5. This intermittent type valve also uses a needle valve 2 similar to that of the conventional EFI injection valve so as to effect the desired control by controlling the valve opening time. Moreover, a guide 19 is provided around the needle valve 2 to continuously flow air through the clearance 20 in between to thereby promote atomization. In other words, the fuel is intermittently injected whereas the air is continuously flown. As a result, improvements in both the controllability of the fuel rate and the atomized condition can be obtained. However, there is still left in the intermittent injection type fuel injection valve such a problem to be practically solved that the flow rate of the air for atomization exceeds that required for the combustion of the engine in a certain driving range of the engine. This problem will be explained with reference to FIG. 6.

Generally speaking, it is well known in the art that in the fuel injection valve the ratio in the flow rate (in weight) of the air for atomization to the fuel has to be at a level of about 2. Here, it is assumed that the maximum fuel flow rate required for an automotive engine is 10 g/s on an average. At this time, the engine speed is about 6000 r.p.m., and the EFI valve is not always opened but the valve opening time is about that corresponding to one half of one rotation. As a result, the actual fuel flow rate for the valve opening time takes a value of about 20 g/s. Assuming that the air-fuel flow rate ratio is 2, the required air flow rate is of a value of 40 g/s. Now, the air for atomization can be expressed by straight line A in FIG. 6 because it is continuously supplied. On the other hand, the air-fuel flow rate ratio for the engine is determined to be about 15 from the consideration of combustion analysis. As a result, the relationship between the air flow rate and fuel flow rate required by the engine can be depicted by straight line B. Inspecting the straight lines A and B for comparison, it is found that the air supply for atomization is excessive in the hatched region in FIG. 6. In this region, more specifically, air is supplied in a larger quantity than the proper level to the engine so that the running operation of the engine cannot be maintained. As a result, it can be concluded that the intermittent injection type fuel injection valve shown in FIG. 5 cannot provide a sufficiently satisfactory fuel feeder to an automotive engine.

The intermittent injection type fuel injection valve thus far described cannot be free from an additional problem that the fuel injected will leak to the back of the injection valve through the clearance between the nozzle body and the needle valve by the action of oil pressure applied so that the desired proper flow rate cannot be effected to raise another difficulty in the relability and durability in the injection valve.

Therefore, the present invention contemplates elimination of the aforementioned problems concomitant with the prior art and provides an intermittent injection type fuel injection valve which comprises a nozzle body comprising a hollow cylindrical member and having a valve seat and an injection port with a predetermined diameter at one end thereof; valve means comprising a movable member having a valve seat at one end, interposed into the nozzle body and intermittently reciprocated therein; a compressed air supply passage communicating with a compressed air supply source and having an air opening provided on or near at least one of the valve seats of the nozzle body and movable member; and a compressed fuel supply passage communicating with a compressed fuel supply source and having at least one fuel opening provided on one of the valve seats of the nozzle body and movable member; and wherein the valve means intermittently controls the on-off communication of the air and fuel openings of the compressed air and fuel supply passages, and the fuel opening of the compressed fuel supply passage is positioned closer to the injection port than the air opening of the compressed air supply passage. Thus, the compressed fuel is supplied to the flow of the compressed air between the valve seats of the nozzle body and movable member, and the mixture of the compressed fuel and air in the form of extremely fine fuel droplets is injected from the injection port at a preset timing in a precise and stable manner under any driving condition of an engine.

According to the intermittent injection type fuel injection valve according to the present invention, since the fuel and the compressed air are intermittently mixed and injected to the outside such that the fuel flow rate is controlled by controlling the valve opening time, the control of the fuel flow rate can be accomplished remarkably precisely and efficiently. Moreover, since the compressed air can be supplied from upstream of the fuel supply position and since the fuel supply is directed to intersect the flow direction of the compressed air, the fuel flow is sheared by the flow of the compressed air, and the fuel itself is also sheared to obtain a doubly atomizing effect. As a result, remarkably fine fuel droplets which have not been obtainable according to the prior art can be generated to remarkably improve the fuel atomizing characteristics.

According to the present invention, moreover, since the compressed air can be supplied from upstream of the fuel supply position, as described above, the fuel can be prevented from leaking without fail to the back of the fuel injection valve through the clearance between the valve device and the nozzle body by the action of the air pressure. Thus, the fuel injection valve according to the present invention can remarkably improve the fuel economy and exhaust purifying percentage of an engine, while attaining prominent effects, especially at the cold start of the engine, so that it can enhance the controllability and responsiveness in the fuel supply and further, the reliability and durability of itself.

The intermittent injection type fuel injection valve according to the present invention will now be described in connection with the embodiments thereof. Incidentally, the same parts of the injection valves thus far described are denoted with the same reference numerals.

Figure 7:
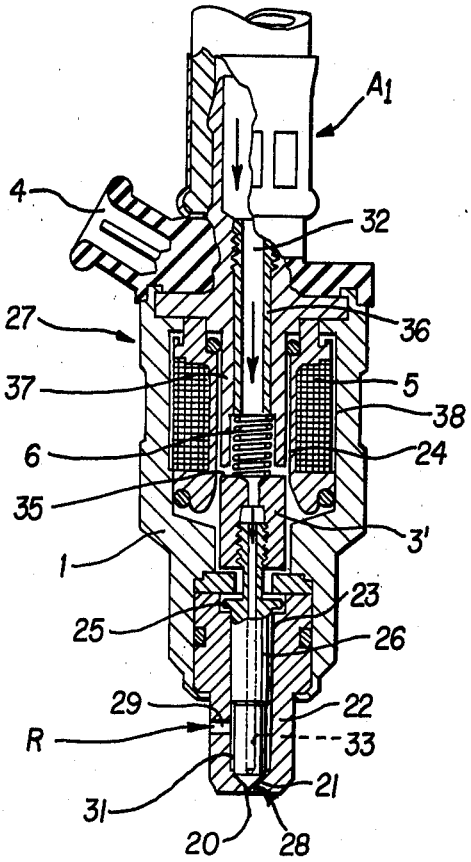
Figure 8:
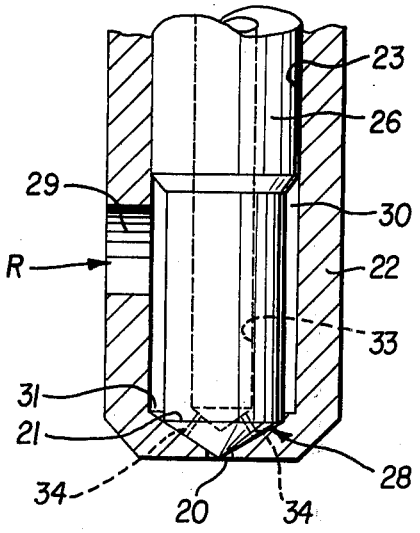

As shown in FIGS. 7 and 8, a fuel injection valve $A_1$ according to the first embodiment of the present invention is of the type in which the plunger 3' is shifted in accordance with the magnetizing pulse voltage impressed upon the solenoid coil 5, and in which the needle valve is moved up and down in response to shifting of the plunger 3' to open and close the compressed air supply passage and the fuel supply passage so that the fuel injection quantity may be regulated in accordance with the length of the power supply time to the solenoid coil 5. This electromagnetic or electronic control type fuel injection valve $A_1$ is constructed to include at the leading end of the nozzle body 1 a nozzle member 22 which is formed with an injection port 20 and a valve seat 21 having communication with the injection port 20 and formed with a conical surface.

The nozzle member 22 and the nozzle body 1 are formed at their center with a needle valve guide bore 23 and a guide bore 24 and, slidably precision fitted in these bores is a needle valve 26 having a stopper 25 with the plunger 3' which is made integral with the needle valve 26. In the inside of the nozzle member 22, the conical tip of the needle valve 26 hermetically abuts against the valve seat 21. The needle valve 26 constitutes a valve device 28 as a control valve which is moved up and down by the magnetization and demagnetization of the solenoid coil 5 in a later-described needle valve electromagnetic control device 27 so that the clearance between the valve seat 21 and the needle valve 26 may be controlled to be opened and closed to intermittently mix the compressed air and the fuel to thereby inject them to the outside. Moreover, the nozzle member 22 has formed in its wall with a compressed air supply passage 29 for communicating the injection port 20 and a compressed air supply source R. The compressed air supply passage 29 is made to communicate with a thin cylindrical clearance 30 which is defined by the valve seat 21, the outer periphery of the reduced diameter part of the needle valve 26 to be seated thereon and with the inner wall of the needle valve guide bore 23. Moreover, the compressed air supply passage 29 has its opening 31 positioned to face the valve seat 21 and the leading end of the needle valve 26 such that it is controlled to be opened and closed by the control valve which consists of the valve seat 21 and the leading end of the needle valve 26 to be seated thereon. Still moreover, the fuel injection valve $A_1$ according to this embodiment is equipped with a pressurized fuel supply passage 32 which extends coaxially through the center of the nozzle body 1.

The pressurized fuel supply passage 32 is made to communicate with the center bore 33 of the needle valve 26 and further with four openings which extend through the leading side wall of the needle valve 26. The openings 34 are positioned to face the conical valve seat 21 so that they may be controlled to be opened and closed by the valve seat 21 acting as their control valve. Moreover, those four openings 34 are directed to intersect substantially at a right angle with the valve surface of the valve seat 21. As a result, the aforementioned compressed air supply passage 29 has its opening 31 positioned upstream of the openings 34 of the pressurized fuel supply passage 32. On the other hand, the pressurized fuel supply passage 32 is made to communicate with a fuel supply source (not shown) through an outside fuel pump (not shown).

The plunger 3' has its other end formed with a spring seat 35 for the spring 6 which is operative to urge the needle valve 26 in the direction to abut against the valve seat. The other end of the spring 6 is positioned to abut against the end portion of a hollow member 36 which is fitted in and made integral with the pressurized fuel supply passage 32. Inside of the side wall of the nozzle body 1, there is arranged, as shown in FIG. 7, around the pressurized fuel supply passage 32 the needle valve electromagnetic control device 27 which is annularly shaped and made operative to control the vertical movements of the needle valve 26 in a sufficiently hermetical and insulating manner. The needle valve electromagnetic control device 27 is equipped with a stationary iron core, which coaxially receives a member forming the pressurized fuel supply passage 32, and with solenoid coil 5 which is wound in plural turns upon the stationary iron core. A yoke 38 partly covers the solenoid coil 5 and partly fixes the stationary iron core. The outer wall member of the nozzle body 1 covers the stationary iron core, the solenoid coil 5, the yoke 38 and the aforementioned nozzle member 22 hermetically and integrally in a satisfactorily insulating manner.

The stationary iron core receives in its bore the end portion of the plunger 3'. As a result, the needle valve electromagnetic control device 27 builds up an electromagnetic attaction under the condition in which the magnetizing pulse voltage is impressed upon the solenoid coil 5 so that it attracts the plunger 3' upwardly to open the clearance between the needle valve 26 and the valve seat 21 to thereby inject and supply the mixed fuel and air. On the contrary, as the magnetizing voltage to the solenoid coil 5 is interrupted, the electromagnetic attraction is simultaneously eliminated so that the plunger 3' is moved down by the action of the spring 6 to close the clearance between the needle valve 26 and the valve seat 21 to thereby block the injection supply of the mixed fuel and air. On the other hand, the solenoid coil 5 is highly conductively connected with the input terminal 4, which in turn is highly conductively connected with the computer (not shown) through a wiring (not shown) so that the injection electric signals which are computed by the computer and amplified by a power amplifier (not shown) can be fed thereto with satisfactory electric characteristics.

Figure 9:
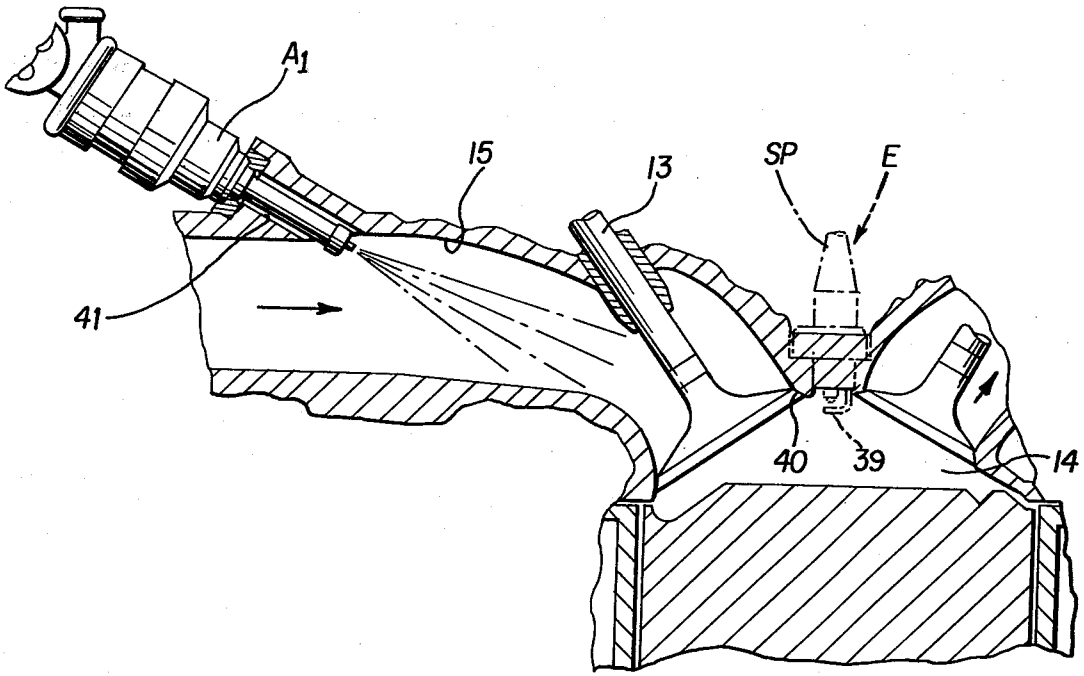

Turning now to FIG. 9, the mode in which the fuel injection valve $A_1$ according to the first embodiment thus far described is applied to a gasoline (or spark ignition) engine will be explained in the following. The same parts as those in FIG. 2 are designated with the same reference numerals in FIG. 9 and their repeated explanation will be omitted here.

The gasoline engine E is of the type in which the supplied fuel is injected into the intake manifold and includes an intake system which is equipped at its upstream port in the intake manifold 15 with an air filter and a throttle valve for controlling the quantity of intake air in accordance with its opening, (both of which are not shown), and at its downstream port with an intake port 40 having communication with the combustion chamber 14 and arranged to face the ignition portion 39 of a spark plug SP and the intake valve 13 for controlling the opening of the intake port 40. The fuel injection valve $A_1$ according to the embodiment thus far described is hermetically mounted in a mounting hole 41, which is formed in the wall of the intake manifold 15 upstream of the intake valve 13, so that injection may be possible in the direction toward the valve seat of the intake valve 13.

The operating effects of the fuel injection valve $A_1$ according to the present embodiment having the above construction will be explained in the following discussion.

In the suction stroke, the gasoline engine E sucks a preset quantity of intake air into the combustion chamber 14 through the intake manifold 15, the throttle valve, the intake valve 13 and the intake port 40. Meanwhile, the compressed air and the fuel are injected and supplied toward the valve seat from the fuel injection valve $A_1$ with excellent atomized characteristics and with high responsiveness to the injection pressure and are efficiently and uniformly diffused and mixed with the aforementioned intake air so that the air-fuel mixture of a preset mixture ratio can be prepared. In the combustion chamber 14, the mixture thus prepared is compressed in the compression stroke and is ignited by the spark plug SP so that the combustion may be properly completed.

Here, the operation of the fuel injection valve $A_1$ according to the present embodiment will be explained in greater detail. As shown in FIG. 7, in case the magnetizing pulse voltage to the solenoid coil 5 is interrupted to erase the electromagnetic attracting force, the fuel injection valve $A_1$ has its plunger 3' held in its lowermost position by the action of the spring 6 to close the clearance between the needle valve 26 and the valve seat 21 to thereby shut off the injection port 20. In case, however, the magnetizing pulse voltage is fed to the solenoid coil 5 to generate the electromagnetic attracting force, the fuel injection valve $A_1$ has its core 3' attracted and moved up against the action of the spring 6 to open the clearance between the needle valve 26 and the valve seat 21 to thereby open the injection port 20. Simultaneously with this action, both the compressed air supply passage 29 and the pressurized fuel supply passage 32 are opened so that the compressed air and the fuel are injected from the injection port 20 into the intake manifold 15 in such fine atomized droplets as to have remarkably excellent atomizing characteristics and as to have remarkably high responsiveness in atomization to the valve opening timing of the needle valve. Moreover, the power supply time to the solenoid coil 5 is controlled in order to control the valve opening time so that the fuel flow rate may be accordingly controlled. Since, in this instance, the compressed air is also injected only during the valve opening time, the flow rate ratio between the compressed air for the atomization and the fuel can be maintained at a value of 1 to 2, and the quantity of the air can be maintained at such a low level in comparison with the quantity of the air demanded by the engine that no problems occur in driving performance. Moreover, the atomized condition of the fuel can be remarkably improved in comparison with that obtainable from the conventional EFI injection valve V by the effects of the compressed air for the atomization. More specifically, since the fuel injection valve $A_1$ according to the present embodiment has its pressurized fuel supply passage 32 formed with the openings 34 arranged in the vicinity of the injection port 20, since the compressed air supply passage 29 has its opening 31 arranged upstream of the openings 34 and since the flow direction of the compressed air for the atomization is directed at a right angle with respect to the supply direction of the fuel, the compressed air flows while shearing the fuel flow so that remarkably finer fuel droplets than those obtained by the coventional fuel injection valve shown in FIG. 5 can be prepared. Since, moreover, the compressed air for the atomization of the conventional fuel injection valve shown in FIG. 5 flows with the fuel flowing at the center of the air, fuel shearing effects of the compressed air cannot be expected to a practical degree. Since, on the contrary, the compressed air of the fuel injection valve $A_1$ of the present embodiment impinges substantially at a right angle upon the fuel flow, this fuel flow is first shorn and then blown off in a double atomizing effect with the resultant excellent practical effect that the fuel can be crushed into remarkably fine droplets. As has been touched on before, on the other hand, since the conventional EFI injection valve V is positioned in the intake manifold 15 in the vicinity of the intake valve 13 so as to supply the fuel to each combustion chamber 14 of the multi-cylinder engine, the number of the EFI injection valves V required is equal to that of the combustion chambers 14. As a result, the conventional EFI injection valve V cannot but provide a system of a considerably high cost. This cost could be remarkably reduced if only one EFI injection valve were mounted, like a carburetor, in the merging portion of the intake manifold. However, the EFI injection valve being commonly used has such insufficient atomizing characteristics that coarse fuel droplets will wet the inner wall of the intake manifold if only one injection valve is mounted in the merging portion of the intake manifold. As a result, the desired uniform distribution of the fuel into the respective combustion chambers is so deteriorated that the engine performance will be accordingly deteriorated. Moreover, fuel wetting the inner wall of the intake manifold adversely affects the responsiveness of the engine because it flows in the form of a liquid film. As has been described before, on the contrary, since the fuel injection valve $A_1$ according to the present embodiment can have the satisfactory atomizing characteristics, such can ensure sufficiently satisfactory uniform distribution of the fuel to the respective combustion chambers and sufficiently satisfactory engine responsiveness even if only one is mounted in the merging portion of the intake manifold 15.

Figure 10:
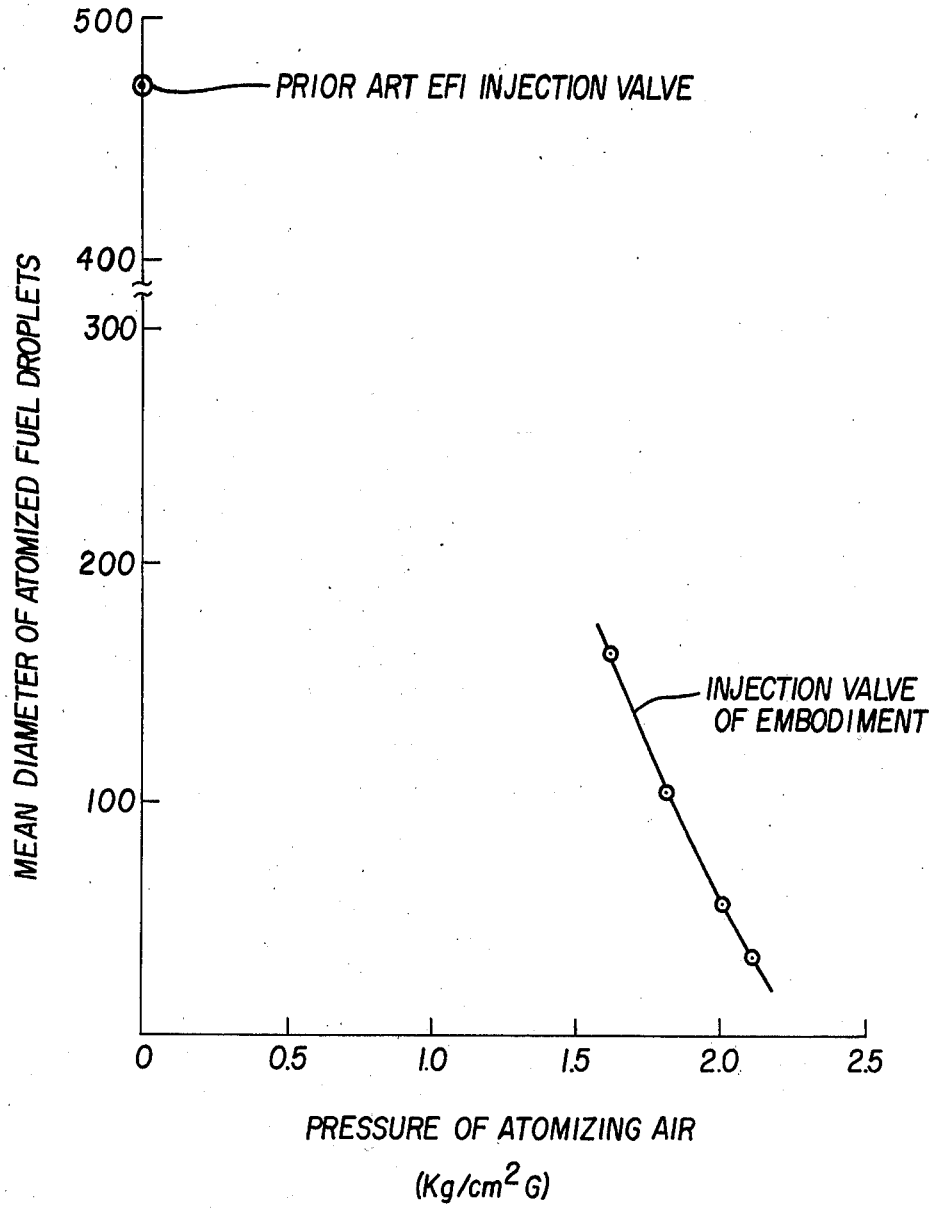
Figure 11:
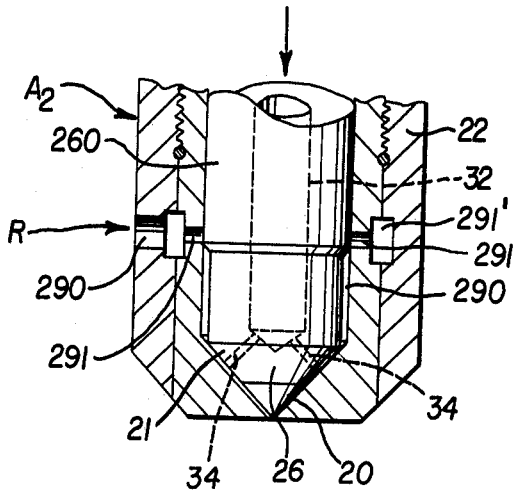

A series of experiments have been conducted by the use of the fuel injection valve $A_1$ according to the present embodiment, and the measuring results of the mean diameters of the atomized fuel droplets are illustrated, merely as one example, in FIG. 10. As will be apparent from FIG. 10, the mean diameter at the point where the pressure in the air for atomization is at a zero level is obtained from the results using the conventional EFI injection valve V. Thus, it can be confirmed that the results obtained from the use of the fuel injection valve according to the present embodiment are remarkably satisfactory.

As is now apparent from the foregoing description, the fuel injection valve $A_1$ according to the present embodiment can realize such remarkably prominent fuel atomizing characteristics and satisfactory responsiveness to the needle valve opening timing as could not be attained by the aforementioned conventional EFI injection valve V and other fuel injection valve.

Since, moreover, the compressed air of the present fuel injection valve $A_1$ is supplied from upstream of the supply position of the fuel, as has been described, the fuel can be completely prevented, by the action of the compressed air, from leaking to the back of the injection valve through the clearance between the needle valve 26 and the needle valve guide bore 23. Since, still moreover, the openings 34 for the fuel are completely shut off by the valve seat 21 and there is no fuel reservoir, the deterioration in the fuel cut and the trailing droplets of the fuel can be completely prevented. Still moreover, the fuel injection valve $A_1$ according to the present embodiment can enjoy such practical effects that its shape, construction and their combination can be remarkably simplified such that its production, working and assembly can, accordingly, be so remarkably simplified as to be suited for mass-production in comparison with the various injection valves according to the prior art, that its durability and reliability can be remarkably excellent without any of the various troubles described hereinabove, and that its handling can be easily accomplished and can be produced at a low cost.

Since, still moreover, the fuel injection valve $A_1$ of the present embodiment can ensure a remarkably excellent fuel supply, as has been described before, when it is applied to the gasoline (or spark ignition) engine of intake manifold of the fuel injection type, complete combustion can be expected, while restraining emission of noxious gases and air pollution due to the exhaust gases, the engine drive can be made stable and smooth to improve various operating efficiencies of the engine to a remarkably extent, and fuel consumption can be remarkably reduced.

The intermittent injection type fuel injection valve according to the present invention should not be limited to the aforementioned embodiment but can include the fuel injection valves as shown in FIGS. 11 through 16. Incidentally, the same parts as those of the foregoing embodiment are designated with the same reference numerals, and their repeated explanation is omitted here excepting their major differences.

In the foregoing embodiment, the compressed air supply passage 29 and the pressurized fuel supply passage 32 are controlled to be opened and closed by the valve seat 21 and the needle valve 26 to be seated thereon. In the intermittent injection type fuel injection valve $A_2$ according to the second embodiment shown in FIG. 11, however, a compressed air supply passage 290 is controlled to be opened and closed further upstream of the (eight) openings 34 of the pressurized fuel supply passage 32. More specifically, an annular passage 291' is formed in the inner and outer races of the nozzle member 22, the annular passage having a plurality of openings 291 to face the outer periphery of a bulged or larger diameter portion 260 (i.e. a portion larger in diameter than the leading portion) of the needle valve 26, so that they are opened and closed by the buldged portion 260. As a result, the aforementioned compressed air supply passage 290 can have its openings doubly controlled by the bulged portion 260, the valve seat 21 at the downstream side and the needle valve 26 to be seated thereon, the conical tip portion of the needle valve 26 being formed by two differently inclined parts. Thus, the highly fine adjustment of the air flow rate can be accomplished with the additional resultant effect that the air-tightness can be completed as well as similar operational results to those of the foregoing embodiment.

Figure 12:
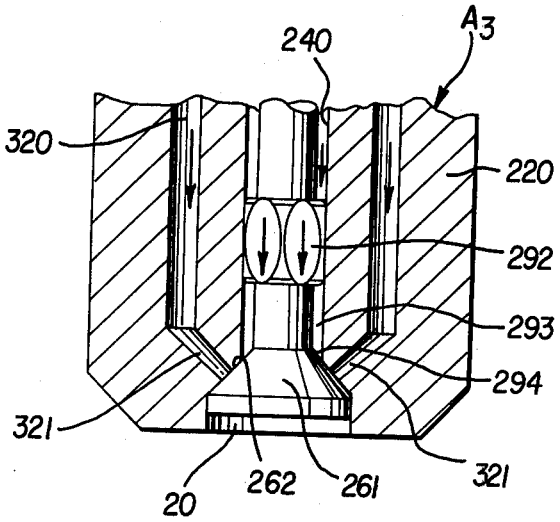

On the other hand, the intermittent injection type fuel injection valve $A_3$ according to the third embodiment shown in FIG. 12 is of an externally open type, having a needle valve of an inverted T shaped, in which the side wall of a nozzle member 220 is formed with two pressurized fuel supply passages 320 each having an opening 321 arranged in a valve seat 210 so that they may be controlled to be opened and closed by the conical portion 262 of a needle valve 261 (having a guide collar member with cut surfaces mounted thereon), and in which a clearance defined by the needle valve guide bore 240 of the nozzle member 220 and the outer wall of the needle valve 261 provides a compressed air supply passage 293 having its opening 294 arranged upstream of the openings 321 of the aforementioned pressurized fuel supply passages 320 and controlled to be opened and closed by the conical portion 262 of the needle valve 261. Except for these differences, the fuel injection valve can attain substantially similar operational results to those of the foregoing embodiments.

The fuel injection valves according to the following fourth to seventh embodiments also provide similar effects to those aforementioned.

Figure 13:
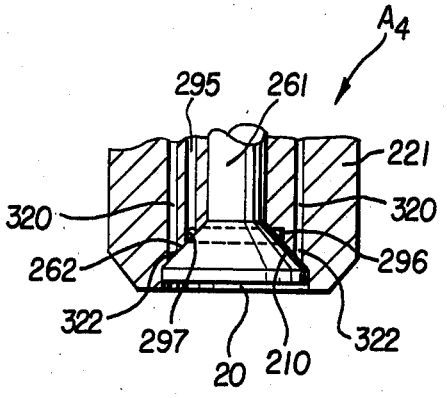

The intermittent injection type fuel injection valve $A_4$ according to the fourth embodiment shown in FIG. 13 is different from the above embodiments in that both the compressed air supply passage 295 and two compressed fuel supply passages 320 are axially provided within the sidewall of the nozzle member 221. The compressed air supply passage 295 is communicated with an annular groove 296 (as an air opening 297) formed in the valve seat 210 of the nozzle member 221, upstream of the fuel openings 322 of the compressed fuel supply passage 320. The annular air opening 297 of the compressed air supply passage 295 and fuel openings 322 of the compressed fuel supply passage 320 are on-off controlled as to their communication by the valve seat 262 of the needle valve 261 of an externally open type or of an inverted T shape.

Figure 14:
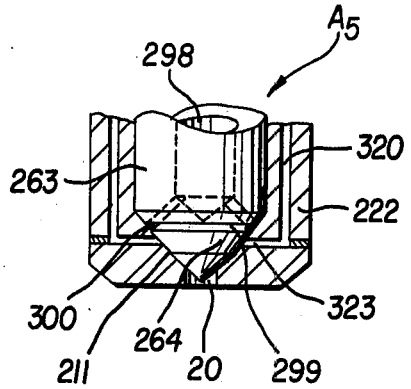

The intermittent injection type fuel injection valve $A_5$ according to the fifth embodiment shown in FIG. 14 is different from the above embodiments in that the compressed air supply passage 298 and the compressed fuel supply passages 320 are provided within the needle valve 263 of an internally open type (i.e. of a type having a tip end of a cone shape including two differently inclined parts) and within the nozzle member 222, respecctively. The compressed air supply passage 298 has two air passages connected to an annular opening 299 (as an air opening 300) which is formed in the valve seat 264 of the needle valve 263, upstream of two fuel openings 323 of the compressed fuel supply passage 320 which are formed in the valve seat 211 of the nozzle member 222. The communication of air and fuel openings are on-off controlled by the valve seats 211 and 264, respectively.

Figure 15:
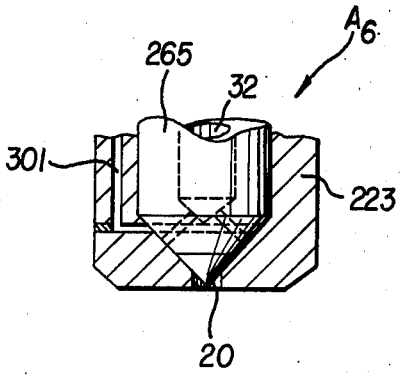

The intermittent injection type fuel injection valve $A_6$ according to the sixth embodiment shown in FIG. 15 is different from the fifth embodiment in that the compressed air and fuel supply passages 301 and 32 are provided within the nozzle member 223 and within the needle valve 265, respectively. The compressed air supply passage 301 is communicated with an annular air opening which is formed in the valve seat of the nozzle member 223, upstream of the fuel openings of the compressed fuel supply passage 32 formed in the valve seat of the needle valve 265.

Figure 16:
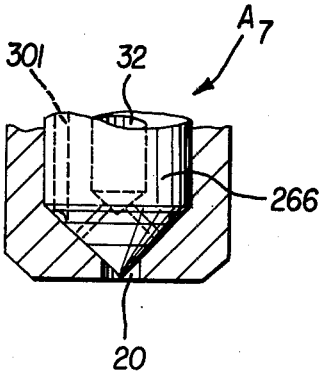

The intermittent injection type fuel injection valve $A_7$ according to the seventh embodiment shown in FIG. 16 has compressed air supply passage 302 and compressed fuel supply passage 32 both provided in the needle valve 266. The compressed air supply passage 302 has an annular air opening formed in the valve seat of the needle valve 266, upstream of the fuel openings.

In the above embodiments, valve means is driven by electromagnetic control means. However, it may be driven by oil pressure control means or mechanical control means.

In short, according to the present invention, there is provided an intermittent injection type fuel injection valve characterized in that an injection port is formed at the leading end of a nozzle body; there are independently provided a compressed air supply passage for communicating the injection port and a compressed air supply source and a fuel supply passage for communicating the injection port and a fuel supply source; there is provided in the nozzle body a valve device having a control valve for intermittently communicating the compressed air supply passage and the fuel supply passage with injection port, the valve device simultaneously injecting the compressed air and the fuel in a mixed manner from the injection port to the outside in response to the opening and closing control of the control valve; the opening of the compressed air supply passage, which is controlled to be opened and closed by the valve device, is positioned upstream of the opening of the fuel supply passage; and in that the opening of the fuel supply passage has its axis directed to intersect the control valve surface of the valve device, whereby the compressed air and the fuel are mixed and injected at a preset timing. As a result, according to the intermittent injection type fuel injection valve according to the present invention, since the fuel and the compressed air are intermittently mixed and injected to the outside such that the fuel flow rate is controlled by controlling the valve opening time, the control of the fuel flow rate can be accomplished remarkably precisely and efficiently in comparison with the prior art. Moreover, since the compressed air can be supplied from upstream of the fuel supply position and since the fuel supply is directed to intersect the flow direction of the compressed air, the fuel flow is sheared by the flow of the compressed air, and the fuel itself is also sheared to obtain the doubly atomizing effects. As a result, remarkably fine fuel droplets which have not been obtainable according to the prior art can be generated to remarkably improve the fuel atomizing characteristics.

According to the present invention, moreover, since the compressed air can be supplied from upstream of the fuel supply positions, as described in the above, the fuel can be prevented, without fail, from leaking to the back of the fuel injection valve through the clearance between the valve device and the nozzel body by the action of the air pressure. Thus, the fuel injection valve according to the present invention can remarkably improve the fuel economy and exhaust purifying percentage of an engine, while attaining prominent effects especially during the cold starting of the engine. Still moreover, the flow injection valve according to the present invention can attain the following practical effects that the construction can be simplified, while facilitating its working and assembling processes, to thereby most properly apply itself to mass production, in that it has remarkably excellent durability and reliability, it can be handled with ease and produced at a low cost, it can attain remarkably excellent fuel atomizing characteristics, and it can have high responsiveness of atomization to the needle valve opening timing. In addition, the fuel injection valve of the present invention can also attain the following practical effects, if it is applied to various industrial fields, e.g., to an internal combustion engine with resultant remarkable advantages, in that the properly mixed injection of fuel and air can be effected to effect the sufficient completion of combustion so that emission of noxious gases can be restrained to prevent the air pollution due to the engine exhaust gases, that the engine can be stably and smoothly run to remarkably improve various operating efficiencies, and that the fuel cost can be remarkably reduced.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An intermittent injection type fuel injection valve comprising:

a nozzle body comprising a hollow cylindrical member and having a valve seat and an injection port with a predetermined diameter at one end thereof;

valve means comprising a movable member having a center bore coaxially extended therethrough and having a valve seat at one end, interposed within said nozzle body and intermittently reciprocated therein;

a compressed air supply passage communicating with a compressed air supply source and having an air opening provided on or near at least one of said valve seat of said nozzle body and movable member, and a compressed fuel supply passage communicating with a compressed fuel supply source through said center bore of said movable member and having at least one fuel opening provided on said valve seat of said movable member;

said valve means intermittently controlling on-off communication of said air and fuel openings of said compressed air and fuel openings of said compressed air and fuel supply passages;

said fuel opening of said compressed fuel supply passage being positioned closer to said injection port than said air opening of said compressed air supply passage;

whereby the compressed fuel is supplied to the flow of the compressed air between said valve seats of said nozzle body and said movable member, and the mixture of the compressed fuel and air is injected from said injection port.

2. An intermittent injection type fuel injection valve according to claim 1, wherein:

said at least one fuel opening opens on said valve seat with a predetermined angle.

3. An intermittent injection type fuel injection valve according to claim 2, wherein:

said compressed air supply passage is provided in said nozzle body.

4. An intermittent injection type fuel injection valve according to claim 2, wherein:

said compressed air supply passage is provided in said movable member of said valve means.

5. An intermittet injection type fuel injection valve according to claim 2, wherein said nozzle body includes an inner wall, said movable member includes an outer wall; and said compressed air supply passage is formed by the clearance between said inner wall of said nozzle body and said outer wall of said movable member of said valve means.

6. An intermittent injection type fuel injection valve according to claim 5, wherein:

said compressed air supply passage further comprises a radial hole connected to said compressed air supply source, an annular passage connected to said radial hole and a plurality of openings connected to said annular passage, communication of said plurality of openings being on-off controlled by a valve seat formed at a shoulder part of said movable member of said valve means.

7. An intermittent injection type fuel injection valve according to claim 6, wherein:

said one end of said movable member of said valve means is of a cone shape.

8. An intermittent injection type fuel injection valve according to claim 7, wherein:

said nozzle body comprises a main body of a hollow member which comprises two parts having two different diameters, a hollow plug member having electric and fuel connectors provided in a top portion of said main body, a hollow intermediate member having a cross shaped longitudinal section interposed within an inner wall of said large diameter part of said main body, an annular member inserted in the annular part of said main body, and a stepped hollow member comprising a stepped outer race having O-ring and an inner race with another O-ring interposed therebetween, said inner race having said valve seat and said injection port at a bottom portion thereof, an upper portion of said stepped hollow member being fixedly inserted within an inner wall of said small diameter part of said main body, said valve means comprise said movable member which further comprises a needle valve having an upper larger and a lower smaller diameter part and a conical tip portion formed by two differently inclined parts as said valve seat, inserted within an inner wall of said inner race of said stepped hollow member, a plunger integrally connected to said needle valve, coil spring means for pressing said plunger inserted within a stepped inner wall of said intermediate member, and a magnetic coil connected to said electric connector of said plug member fixedly inserted between an inner wall of said large diameter part of said main body and a lower outer wall of said intermediate member, said compressed air supply passage is formed by the clearance between an inner wall of said inner race of said stepped hollow member and an outer wall of said smaller diameter part of said needle valve, and said compressed air supply passage further comprises said radial hole formed within said outer race of said stepped hollow member, said annular passage formed in said inner and outer races of said stepped hollow member, and said plurality of openings to face said valve seat at said shoulder portion along the outer periphery of said larger diameter part of said needle valve, one end of said clearance forming said compressed air supply passage being intermittently communicated with said compressed air supply source through said plurality of openings, said annular passage and said radial hole, and the other end of said clearance as said air opening being positioned to face said valve seats of said stepped hollow member and said needle valve, said compressed fuel supply passage comprises a first tube inserted within an inner wall of said intermediate member and connected to said fuel connector of said plug member of said nozzle member and a second tube coaxially extended through said plunger, said annular member and said needle valve, said second tube having eight openings at lower portions thereof which extend through a leading side wall of said needle valve in a direction to intersect substantially at a right angle the valve surface of said valve seat of said stepped hollow member.

9. An intermittent injection type fuel injection valve according to claim 5, wherein:

said one end of said movable member of said valve means is of a cone shape.

10. An intermittent injection type fuel injection valve according to claim 9, wherein:

said nozzle body comprises a main body of a hollow member which comprises two parts having two different diameters, a hollow plug member having electric and fuel connectors provided in a top portion of said main body, a hollow intermediate member having a cross shaped longitudinal section interposed within an inner wall of said large diameter part of said main body, an annular member inserted in the annular part of said main body, and a stepped hollow member having O-ring and having said valve seat and said injection port at a bottom portion thereof, an upper portion thereof being fixedly inserted within an inner wall of said small diameter part of said main body, said valve means comprises said movable member which further comprises a needle valve having an upper larger and a lower smaller diameter part and a conical tip portion as said valve seat, inserted within an inner wall of said stepped hollow member of said nozzle body, a plunger integrally connected to said needle valve, coil spring means for pressing said plunger inserted within a stepped inner wall of said intermediate member, and a magnetic coil connected to said electric connector of said plug member fixedly inserted between an inner wall of said large diameter part of said main body and a lower outer wall of said intermediate member, said compressed air supply passage is formed by the clearance between an inner wall of said stepped hollow member of said nozzle body and an outer wall of said smaller diameter part of said needle valve, said compressed air supply passage being intermittently communicated with said compressed air supply source through a hole formed in the wall of said stepped hollow member of said nozzle body and said air opening of said compressed air supply passage is positioned to face said valve seats of said stepped hollow member and said needle valve, said compressed fuel supply passage comprises a first tube inserted within an inner wall of said intermediate member and connected to said fuel connector of said plug member of said nozzle member and a second tube coaxially extended through said plunger, said annular member and said needle valve, said second tube having four fuel openings at lower portions thereof which extend through a leading side wall of said needle valve in a direction to intersect substantially at a right angle the valve surface of said valve seat of said stepped hollow member.

11. An intermittent injection type fuel injection valve according to claim 2, wherein:

said one end of said movable member of said valve means is of a cone shape.

12. An intermittent injection type fuel injection valve according to claim 2, wherein:

said valve means is driven by control means comprising electromagnetic control means.

13. An intermittent injection type fuel injection valve comprising:

a nozzle body comprising a hollow cylindrical member and having a valve seal and an injection port with a predetermined diameter at one end thereof;

valve means comprising a movable member having a valve seat at one end, interposed within said nozzle body and intermittently reciprocated therein;

a compressed air supply passage communicating with a compressed air supply source and having an air opening provided on or near at least one of said valve seat of said nozzle body and movable member, and a compressed fuel supply passage communicating with a compressed fuel supply source and having at least one fuel opening provided on said valve seat of said movable member;

said valve means intermittently controlling on-off communication of said air and fuel openings of said compressed air and fuel openings of said compressed air and fuel supply passages;

said fuel opening of said compressed fuel supply passage being positioned closer to said injection port than said air opening of said compressed air supply passage;

whereby the compressed fuel is supplied to the flow of the compressed air between said valve seats of said nozzle body and movable member, and the mixture of the compressed fuel and air is injected from said injection port wherein said compressed fuel supply passage is provided in said nozzle body and wherein said compressed air supply passage is provided in said movable member of said valve means.

* * * * *